US007482997B2

(12) United States Patent
Yang et al.

(10) Patent No.: US 7,482,997 B2
(45) Date of Patent: Jan. 27, 2009

(54) VOLTAGE/CURRENT DRIVEN ACTIVE MATRIX ORGANIC ELECTROLUMINESCENT PIXEL CIRCUIT AND DISPLAY DEVICE

(75) Inventors: Yil Suk Yang, Daejeon (KR); Dae Woo Lee, Daejeon (KR); Jong Dae Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 679 days.

(21) Appl. No.: 11/197,013

(22) Filed: Aug. 4, 2005

(65) Prior Publication Data

US 2006/0108941 A1 May 25, 2006

(30) Foreign Application Priority Data

Nov. 25, 2004 (KR) ..... 10-2004-0097666

(51) Int. Cl.
*G09G 3/00* (2006.01)

(52) U.S. Cl. ..... 345/30; 345/31; 345/32

(58) Field of Classification Search ..... 345/6, 345/15, 30–33, 38, 45, 55–58, 76–88, 204, 345/419, 690; 315/169.1–169.3, 209 R, 315/291; 341/135, 139
See application file for complete search history.

(56) References Cited

U.S. PATENT DOCUMENTS 6,362,798 B1 * 3/2002 Kimura et al. ..... 345/55
6,535,185 B2 * 3/2003 Kim et al. ..... 345/76
7,046,240 B2 * 5/2006 Kimura ..... 345/212
7,355,571 B2 * 4/2008 Yamada et al. ..... 345/76
7,362,249 B2 * 4/2008 Kim et al. ..... 341/139
7,420,492 B2 * 9/2008 Kim et al. ..... 341/135
2003/0112205 A1 * 6/2003 Yamada ..... 345/32
2004/0021620 A1 * 2/2004 Mikami et al. ..... 345/30
2004/0246241 A1 * 12/2004 Sato et al. ..... 345/204
2005/0046619 A1 * 3/2005 Senda et al. ..... 345/76

FOREIGN PATENT DOCUMENTS

KR 20020056353 7/2002
KR 10-2004-0072215 8/2004

OTHER PUBLICATIONS

'Pixel-Driving Methods for Large-Sized Poly-Si AM-OLED Displays' Yumoto et al., Asia Display/IDW 2001, pp. 1395-1398.

* cited by examiner

*Primary Examiner*—Prabodh M Dharia

(57) ABSTRACT

Provided is a voltage/current driven active matrix organic electroluminescent (EL) pixel circuit. In particular, a voltage/current driven active matrix organic EL pixel circuit capable of driving organic ELs by a voltage programming method and a current programming method using one pixel circuit and an organic EL display device that uses such a pixel circuit are provided. The voltage/current driven active matrix organic EL pixel circuit can be used for a voltage driven active matrix organic EL and a current driven active matrix organic EL by programming such that the flexibility and applicability of the pixel circuit and the driving circuit are excellent.

15 Claims, 7 Drawing Sheets

VOLTAGE/CURRENT DRIVEN ACTIVE MATRIX ORGANIC ELECTROLUMINESCENT PIXEL CIRCUIT AND DISPLAY DEVICE

CROSS-REFERENCE TO RELATED APPLICATION

This application claims priority to and the benefit of Korean Patent Application No. 2004-97666, filed Nov. 25, 2004, the disclosure of which is incorporated herein by reference in its entirety.

BACKGROUND

1. Field of the Invention

The present invention relates to a voltage/current driven active matrix organic electroluminescent (EL) pixel circuit capable of performing voltage and current programming using one pixel circuit and an organic EL display device using the same.

2. Discussion of Related Art

In general, a method of driving a flat panel display is divided into a passive driving method and an active driving method. According to the active driving method, a thin film transistor (TFT) that operates as a switch and a storage capacitor that stores data are included in each pixel. Such an active driving method is divided into a voltage driving method and a current driving method. According to the voltage driving method, the final output of data programmed in a pixel circuit is in the form of voltage. According to the current driving method, the final output of data programmed in the pixel circuit is in the form of current. Such voltage and current driving methods vary in accordance with a liquid crystal device mounted in the flat panel display. An organic EL display device is a display device driven by current.

FIG. 1 is a circuit diagram of a conventional voltage driven active matrix organic EL pixel circuit. As shown in FIG. 1, the conventional voltage driven active matrix organic EL pixel circuit includes two TFTs T1 and T2, a storage capacitor Cs, and an organic light emitting diode (hereinafter, referred to as OLED). In FIG. 1, T1 is a switching TFT which turns on and off in response to a gate signal transmitted to a gate line and transmits data in a source line to one end of the storage capacitor Cs such that the data is programmed in the storage capacitor Cs. T2 is a voltage driven TFT and operates as a voltage source for driving a power source applied to a power line in accordance with the data programmed in the storage capacitor Cs to emit light from the OLED to a predetermined level.

FIG. 2 is a circuit diagram of a conventional current driven active matrix organic EL pixel circuit. As shown in FIG. 2, the conventional current driven active matrix organic EL pixel circuit includes four TFTs T1, T2, T3, and T4, a storage capacitor Cs, and an OLED. In FIG. 2, T1 and T2 are switching TFTs which turn on and off in response to a gate signal transmitted to a gate line and transmit data in a source line to one end (N1) of the storage capacitor Cs such that the data is programmed in the storage capacitor Cs. T3 and T4 are current driven TFTs and operate as a current mirror type source for driving a power source applied to a power line in accordance with the data programmed in the storage capacitor Cs to emit light from the OLED to a predetermined level.

On the other hand, the conventional voltage driven active matrix organic EL pixel circuit illustrated in FIG. 1 has a simple structure and is similar to a conventional voltage driven LCD such that a driving IC can be used as it is. However, picture quality significantly deteriorates due to non-uniformity in TFTs and it is very difficult to control grayscales since the organic EL is a current driven device.

Also, according to the conventional current driven active matrix organic EL pixel circuit illustrated in FIG. 2, it is possible to directly control current such that it is possible to compensate for deterioration in picture quality due to non-uniformity in TFTs and to easily control the gray scales. However, the conventional current driven active matrix organic EL pixel circuit has a complicated structure and requires a driving IC only for the organic EL.

SUMMARY OF THE INVENTION

The present invention is directed to implementation of a voltage/current driven active matrix organic EL pixel circuit capable of driving voltage and current driven active matrix organic ELs with one pixel circuit by a program and an organic EL display device using the same.

According to achieve the above object, one aspect of the present invention is to provide a voltage/current driven active matrix organic electroluminescent pixel circuit, comprising: a first switching transistor for transmitting current data of a data line; a second switching transistor having a gate connected to the data line and for converting voltage data into current to transmit the current; a third switching transistor for intercepting the operation of the second switching transistor during the operation of the first switching transistor; a capacitor in which one of the current data and the voltage data is programmed; and current mirror type first and second driving transistors for supplying current to an organic light emitting diode corresponding to the data programmed in the capacitor.

According to another aspect of the present invention, there is provided a voltage/current driven active matrix organic electroluminescent pixel circuit comprising first to fifth transistors each having a source, a drain, and a gate, the organic electroluminescent pixel circuit comprising: a first transistor having the source connected to a power line and the drain connected to the gate thereof; a second transistor having the source connected to the power line, the drain connected to an organic light emitting diode, and the gate connected to the gate of the first transistor; a capacitor including a first electrode and a second electrode and having the first electrode connected to the gates of the first and second transistors and the second electrode connected to the power line; a third transistor having the source connected to a source line, the drain connected to the drain of the first transistor, and the gate connected to a gate line; a fourth transistor having the source connected to a ground and the gate connected to the source line; and a fifth transistor having the drain connected to the drain of the first transistor, the source connected to the drain of the fourth transistor, and the gate connected to the gate line.

The third and fifth transistors of the voltage/current driven active matrix organic EL pixel circuit may be selectively turned on based on one of a high level and a low level of a gate signal transmitted to the gate line.

According to yet another aspect of the present invention, there is provided a voltage/current driven active matrix organic electroluminescent pixel circuit comprising first to fifth transistors each comprising a source, a drain, and a gate, the organic electroluminescent pixel circuit comprising: a first transistor having the source connected to a power line and the drain connected to the gate thereof; a second transistor having the source connected to the power line, the drain connected to an organic light emitting diode, and the gate connected to the gate of the first transistor; a capacitor including a first electrode and a second electrode and having the first electrode connected to the gates of the first and second transistors and the second electrode connected to the power line; a third transistor having the drain connected to a source line, the source connected to the drain of the first transistor, and the gate connected to a current gate line; a fourth transistor having the source connected to a ground and the gate connected to the source line; and a fifth transistor having the drain connected to the drain of the first transistor, the source connected to the drain of the fourth transistor, and the gate connected to a voltage gate line.

The voltage/current driven active matrix organic electroluminescent pixel circuit may further include a data mode control unit for performing a logic operation on input gate and data mode selection signals to output one of a current gate signal and a voltage gate signal to one of the current gate line and the voltage gate line.

According to still another aspect of the present invention, there is provided a voltage/current driven active matrix organic electroluminescent display device comprising: a plurality of pixels each including any one of the above-described voltage/current driven active matrix organic electroluminescent pixel circuits and the organic light emitting diode; a gate driver for selectively supplying one of a voltage gate signal and a current gate signal to at least one gate line connected to the plurality of pixels; a source driver for supplying voltage/current data to source lines connected to the plurality of pixels; and a controller for controlling the gate driver and the source driver.

The gate driver may include a data mode control unit using a gate signal and a data mode selection signal output from a shift register in a predetermined order as two inputs to perform a logic operation on the two inputs such that one of the current gate signal and the voltage gate signal is output.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF PREFERRED EMBODIMENTS

Figure 1:
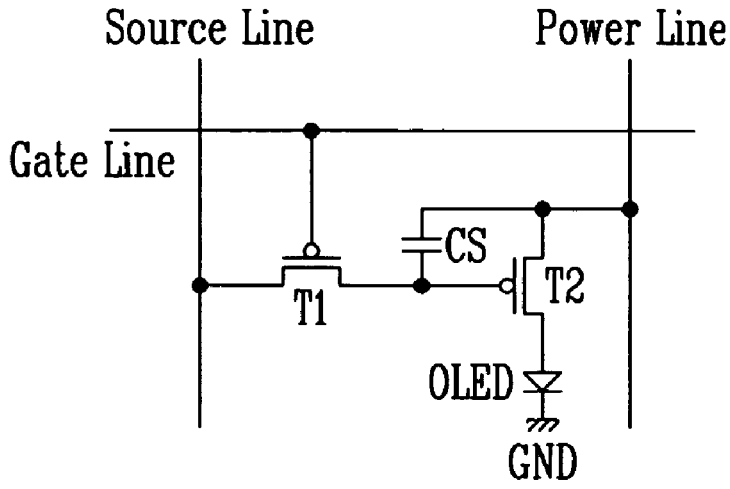
FIG. 1 (PRIOR ART)
FIG. 1 is a circuit diagram of a conventional voltage driven active matrix organic EL pixel circuit.
Figure 2:
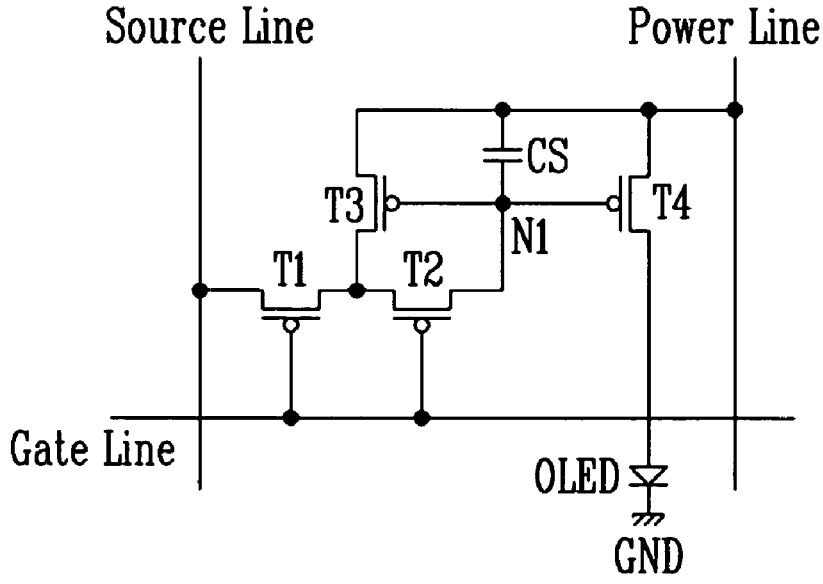
FIG. 2 (PRIOR ART)
FIG. 2 is a circuit diagram of a conventional current driven active matrix organic EL pixel circuit.

Hereinafter, an exemplary embodiment of the present invention will be described in detail. However, the present invention is not limited to the embodiments disclosed below, but can be implemented in various types. Therefore, the present embodiment is provided for complete disclosure of the present invention and to fully inform the scope of the present invention to those ordinarily skilled in the art. The same reference numerals in different drawings represent the same element.

Figure 3:
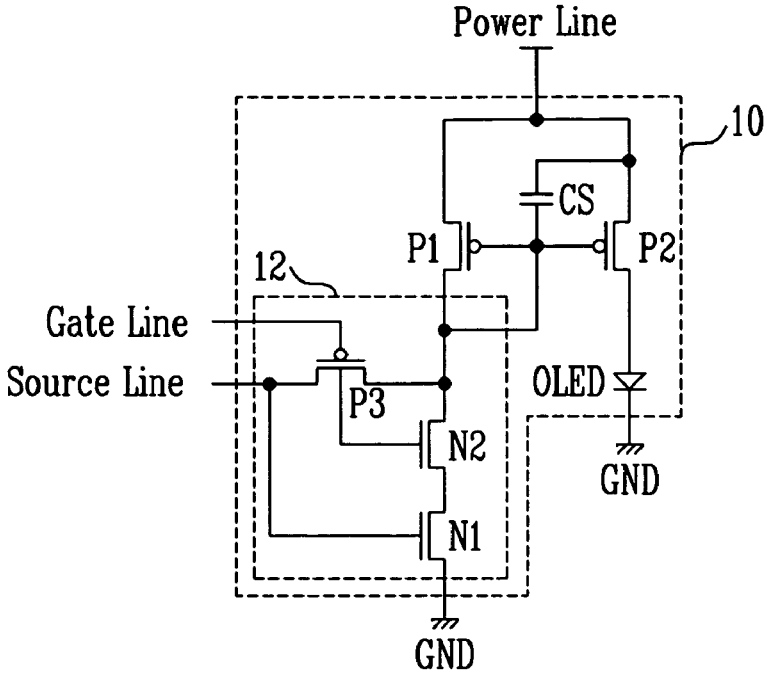
FIG. 3 is a circuit diagram of a voltage/current driven active matrix organic EL pixel circuit according to a first embodiment of the present invention.

FIG. 3 is a circuit diagram of a voltage/current driven active matrix organic EL pixel circuit according to a first embodiment of the present invention.

Referring to FIG. 3, a pixel circuit 10 according to the first embodiment of the present invention programs data in a source line in a storage capacitor Cs in accordance with a gate signal transmitted to a gate line and supplies a power source applied to a power line to an organic light emitting diode (OLED) using the data programmed in the storage capacitor Cs in accordance with a data level. At this time, the data in the source line is selected by a data mode switching unit 12 in the pixel circuit 10 and is programmed in the pixel circuit in either a voltage mode or a current mode. Therefore, the pixel circuit 10 includes five transistors P1, P2, P3, N1, and N2 and a storage capacitor Cs. Here, each transistor includes a source, a drain, and a gate. The storage capacitor Cs includes a first electrode and a second electrode.

To be specific, the source of the first transistor P1 is connected to the power line. The drain of the first transistor P1 is commonly connected to the drain of the third transistor P3 and to the drain of the fifth transistor N2 and is connected to the gate of the first transistor P1. The gate of the first transistor P1 is commonly connected to the gate of the second transistor P2 and to the first electrode of the storage capacitor Cs and is connected to the drain of the first transistor P1.

The source of the second transistor P2 is connected to the power source. The drain of the second transistor P2 is connected to the first electrode (or the anode electrode) of the OLED. The gate of the second transistor P2 is connected to the gate of the first transistor P1 and to the first electrode of the storage capacitor Cs. Here, the second electrode (or the cathode electrode) of the OLED is connected to a ground GND. The ground includes 0V or a negative voltage.

The first electrode of the storage capacitor Cs is commonly connected to the drain and gate of the first transistor P1 and to the gate of the second transistor P2. The second electrode of the storage capacitor Cs is commonly connected to the source and power line of the second transistor P2.

The data mode switching unit 12 includes third to fifth transistors P3, N1, and N2. The source of the third transistor P3 is connected to the source line. The drain of the third transistor P3 is commonly connected to the drain and gate of the first transistor P1, to the drain of the fifth transistor N2, and to the first electrode of the storage capacitor Cs. The gate of the third transistor P3 is connected to the gate line. The drain of the fourth transistor N1 is connected to the drain of the fifth transistor N2. The source of the fourth transistor N1 is connected to the ground GND. The gate of the fourth transistor N1 is commonly connected to the source line and to the source of the third transistor P3. The gate of the fifth transistor N2 is commonly connected to the gate line and to the gate of the third transistor P3. Therefore, the data mode switching unit 12 transmits the current/voltage data of the source line to the gates of the current mirror type driving transistors P1 and P2 through the third transistor P3 or the fifth transistor N2 which is selectively turned on in accordance with the level of the gate signal transmitted to the gate line.

According to the above-described structure, the data mode switching unit 12 of the pixel circuit 10 according to the present invention transmits the data in the source line to the first electrode of the storage capacitor Cs in either the voltage mode or the current mode. The first and second transistors P1 and P2 operate as current mirror type current sources that supply current to the OLED in accordance with the data programmed in the storage capacitor Cs.

Figure 4A:
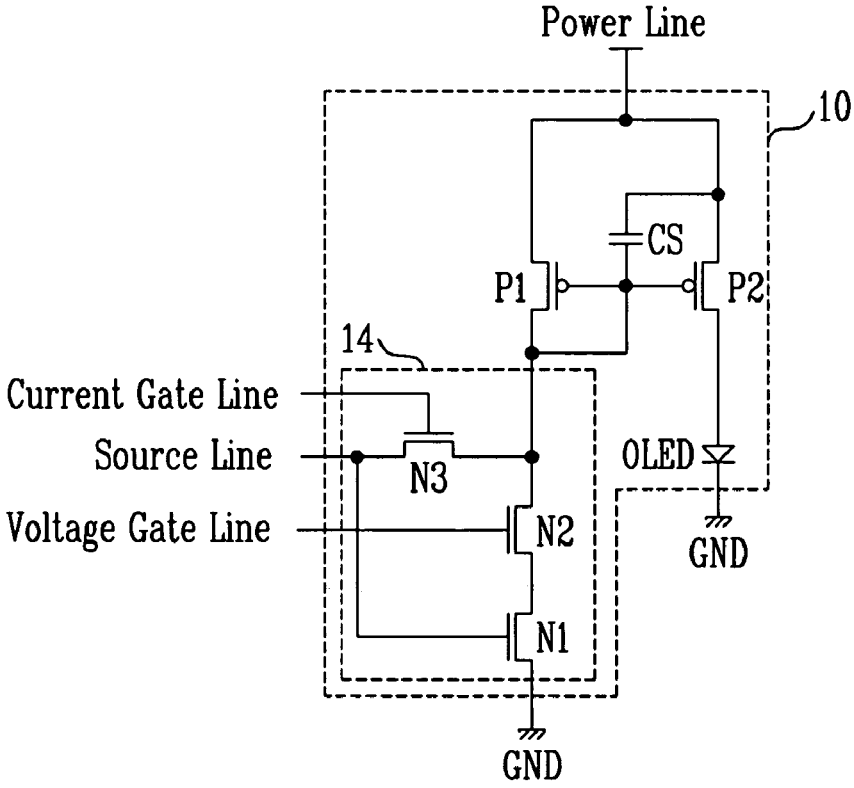
FIG. 4A is a circuit diagram of a voltage/current driven active matrix organic EL pixel circuit according to a second embodiment of the present invention.
Figure 4B:
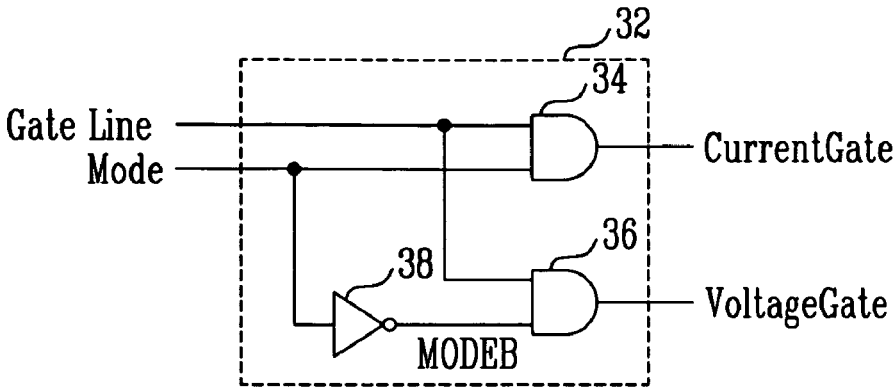
FIG. 4B is a circuit diagram of a data mode control unit that can be used for the organic EL pixel circuit of FIG. 4A.

FIG. 4A is a circuit diagram of a voltage/current driven active matrix organic EL pixel circuit according to a second embodiment of the present invention, and FIG. 4B is a circuit diagram of a data mode control unit that can be used for the organic EL pixel circuit of FIG. 4A. The pixel circuit of FIG. 4A is actually the same as the pixel circuit illustrated with reference to FIG. 3 excluding a data mode switching unit 14. Therefore, a description of the pixel circuit of FIG. 4A that overlaps the description of the pixel circuit of FIG. 3 will be omitted.

Referring to FIGS. 4A and 4B, the pixel circuit 10 according to the second embodiment of the present invention includes five transistors P1, P2, N1, N2, and N3 including the data mode switching unit 14, a storage capacitor Cs, an OLED, and a data mode control unit 32. Here, the data mode control unit 32 is composed of two input AND gates 34 and 36 and an inverter 38. Input signals of the data mode control unit 32 include a gate signal transmitted to the gate line and a data mode selection signal MODE for selecting the data of the source line to be in either voltage or current mode. An output signal includes one of a voltage gate signal and a current gate signal Among the above-described five transistors, the first and second transistors P1 and P2 are current mirror type driving transistors.

The third transistor N3 is a current switching transistor capable of selecting current type data. The gate of the third transistor N3 is connected to an output Current Gate CG of the first AND gate 34 having the data mode selection signal MODE and the gate signal of the gate line as two inputs. The source of the third transistor N3 is connected to the source line. The drain of the third transistor N3 is connected to the drain and gate of the first transistor P1.

The fourth and fifth transistors N1 and N2 are voltage switching transistors capable of selecting voltage type data. The fourth and fifth transistors N1 and N2 are N-type transistors and are serially connected to each other. The gate of the fourth transistor N1 is connected to the source line. The source of the fourth transistor N1 is connected to the ground GND. According to such a structure, the fourth transistor N1 converts the voltage data connected to the gate thereof into current. Also, the gate of the fifth transistor N2 is connected to an output Voltage Gate VG of the second AND gate 36 having a data mode selection signal bar MODEB that is an output of an inverter 38 of the data mode selection signal MODE and the gate signal as two inputs. The drain of the fifth transistor N2 is connected to the drain and gate of the first transistor P1. According to such a structure, the fifth transistor N2 is turned off when the third transistor N3 is turned on. The operation of the fourth transistor N1 is intercepted when data is programmed through the third transistor N3.

When the data mode selection signal MODE is at a high level in the data mode control unit 32, the third transistor N3 is turned on by the output Current Gate CG of the first AND gate 34 such that the current data is stored in the storage capacitor Cs and the light is emitted from the OLED.

On the other hand, when the data mode selection signal MODE is at a low level, the output of the inverter 36 is at the high level such that the fifth transistor N2 is turned on by the output Voltage Gate VG of the second AND gate 36. Therefore, the voltage data is converted into current such that the current is stored in the storage capacitor Cs and the light is emitted from the OLED.

As described above, the data mode selection signal MODE can be selected by programming and in accordance with a method of driving a panel. For example, when a panel is driven by voltage, the data mode selection signal MODE is programmed to be at the low level. When the panel is driven by current, the data mode selection signal MODE is programmed to be at the high level.

Figure 5:
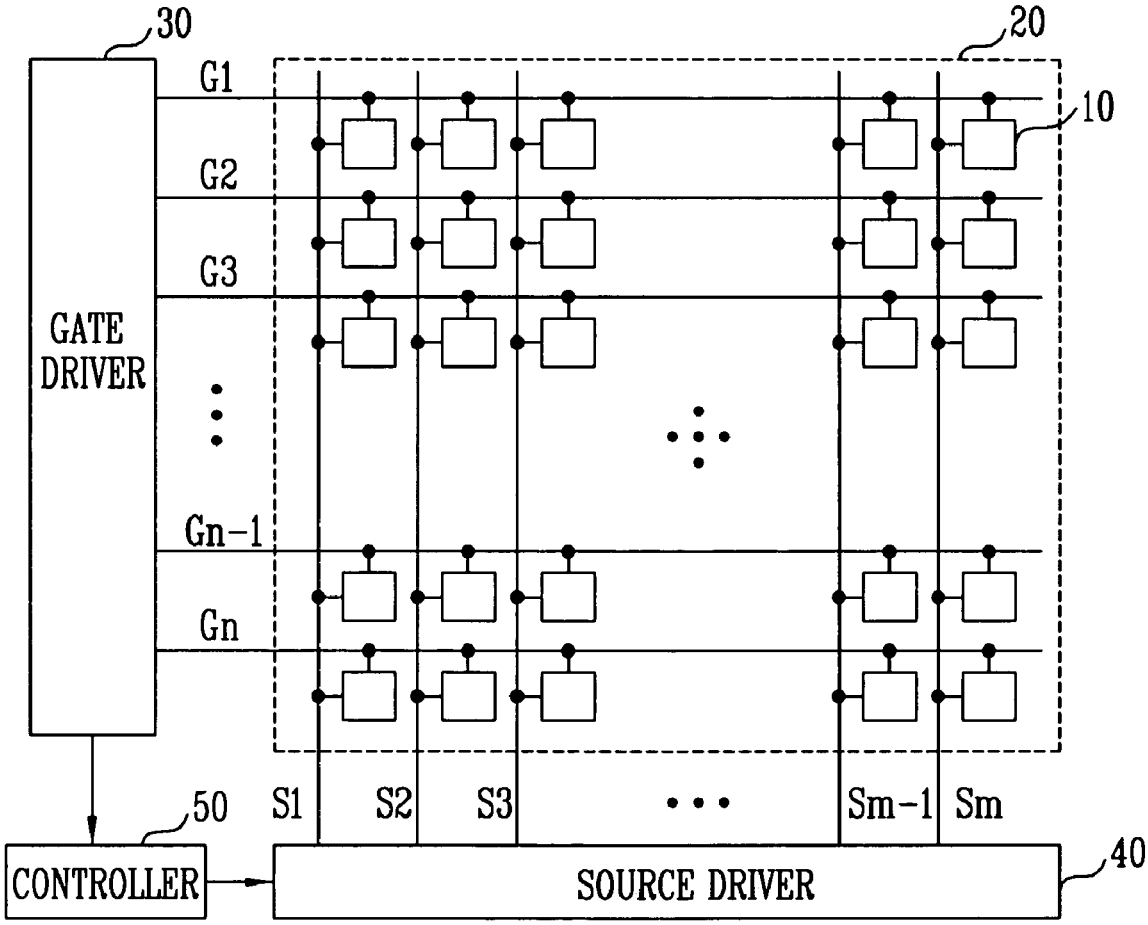
FIG. 5 is a block diagram of an organic EL display device that uses the voltage/current driven active matrix organic EL pixel circuit according to the first embodiment of the present invention.
Figure 6A:
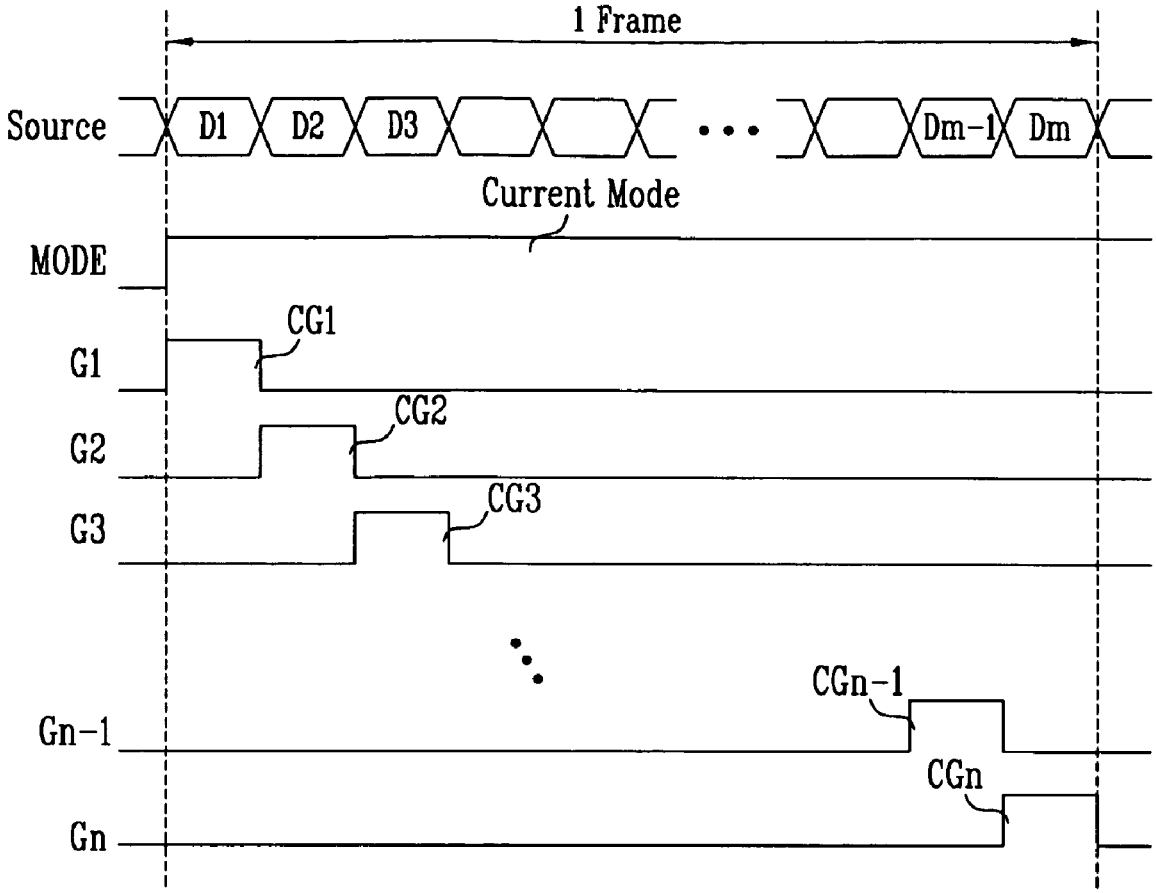
FIGS. 6A and 6B are timing diagrams of a gate signal and data in a current data mode and a voltage data mode in an organic EL display device according to the present invention.
Figure 6B:
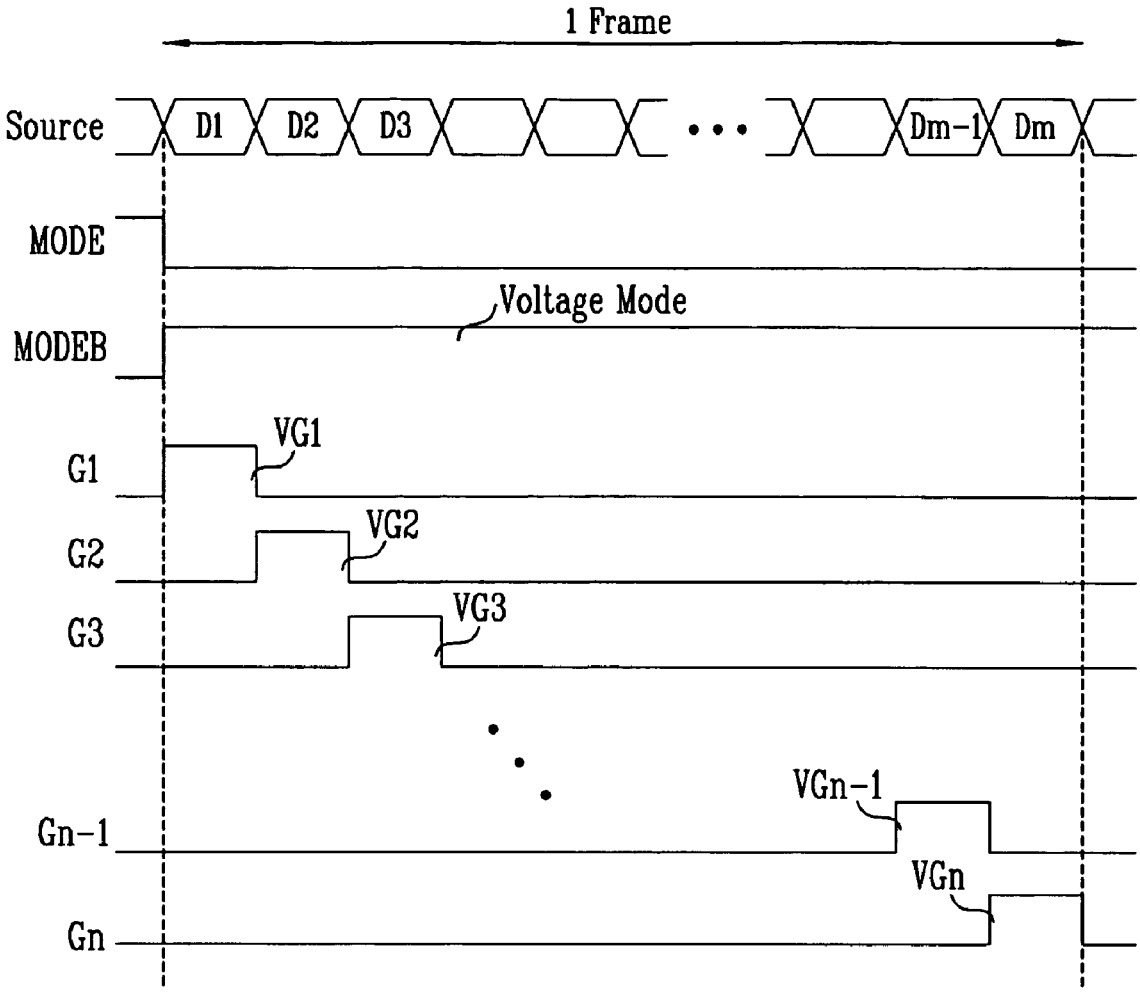

FIG. 5 is a block diagram of an organic EL display device that uses the voltage/current driven active matrix organic EL pixel circuit according to the first embodiment of the present invention. FIGS. 6A and 6B are timing diagrams of a gate signal and data in a current data mode and in a voltage data mode in the organic EL display device according to the present invention.

Referring to FIGS. 5, 6A, and 6B, a light emitting display device according to the present invention is voltage driven or current driven using one voltage/current driven active matrix pixel circuit to display images. Therefore, the light emitting display device includes a plurality of pixels 10, an image display unit 20 including gate lines G1, G2, G3, . . . , Gn-1, and Gn and source lines S1, S2, S3, . . . , Sn-1, and Sn connected to the pixels 10, a gate driver 30, a source driver 40, and a controller 50. Here, each of the pixels 10 includes a pixel circuit according to the first embodiment of the present invention previously described with reference to FIG. 3.

To be specific, the gate driver 30 supplies a gate signal to the gate lines G1, G2, G3, . . . , Gn-1, and Gn. At this time, the gate driver 30 supplies the gate signal of the high level or the low level appropriate to the kind (voltage data or current data) of the image data supplied from the source driver 40 to each of the pixels 10 in accordance with the data mode selection signal MODE. Here, the data mode selection signal MODE is generated in the gate driver 30 or is input from the controller 50.

For example, as illustrated in FIG. 6A, the gate driver 30 sequentially supplies current gate signals CG1, CG2, CG3, . . . , CGn-1, and CGn to the respective gate lines G1, G2, G3, . . . , Gn-1, and Gn during one frame when the data mode selection signal MODE is at the high level that displays a current data mode. At this time, predetermined current data D1, D2, D3, . . . , Dn-1, and Dn in the respective source lines are programmed in the respective pixel lines in accordance with the current gate signals. On the other hand, the gate driver 30 sequentially supplies voltage gate signals VG1, VG2, VG3, . . . , VGn-1, and VGn to the respective gate lines G1, G2, G3, Gn-1, and Gn during one frame when the data mode selection signal MODE is at the low level such that the data mode selection signal bar MODEB displays a voltage data mode at the high level. At this time, predetermined voltage data D1, D2, D3, . . . , Dn-1, and Dn in the respective source lines are programmed in the respective pixel lines in accordance with the voltage gate signals. Here, the voltage gate signals and the current gate signals represent the gate signals selected in accordance with the voltage or current data supplied from the source driver.

On the other hand, the above-described gate signals can be supplied by a dual scanning method, an interlaced scanning method, or other scanning methods as well as by the above-described single scanning or progressive scanning method.

The source driver 40 supplies image data to the source lines S1, S2, S3 . . . , Sn-1, and Sn.

The controller 50 generates a predetermined control signal to control the gate driver 30 and the source driver 40. The controller 50 may supply the data mode selection signal MODE of the high level or the low level to the gate driver 30.

According to the above-described structure, it is possible to provide an organic EL display device capable of selecting a voltage or current type active driving method using one pixel circuit. Also, it is possible to provide a both-surface display device capable of supplying data appropriate to the characteristics of the respective panels using the same pixel circuit like a display device on whose one surface an LCD panel is mounted and on whose the other surface an organic EL panel is mounted.

Figure 7:
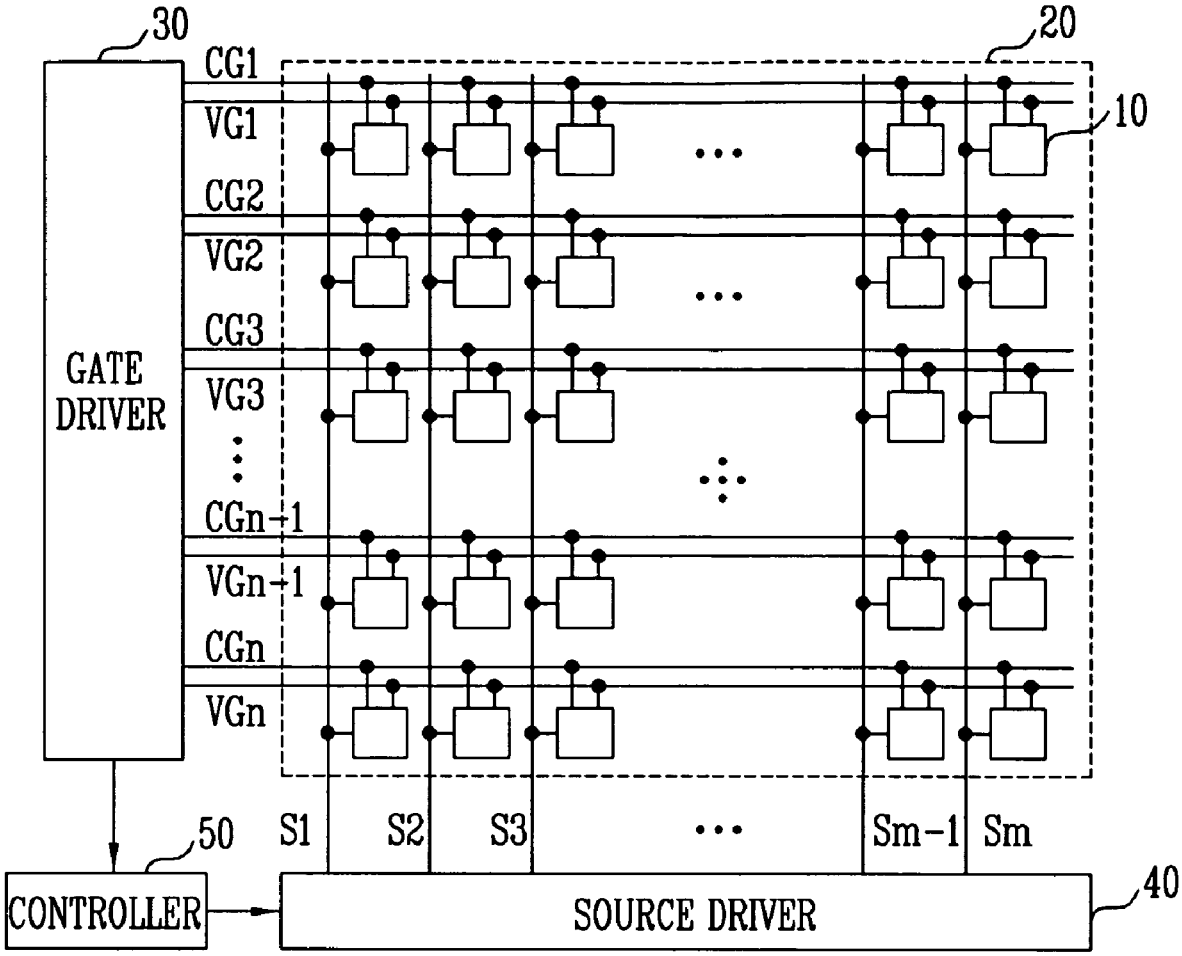
FIG. 7 is a block diagram of an organic EL display device that uses the voltage/current driven active matrix organic EL pixel circuit according to the second embodiment of the present invention.
Figure 8:
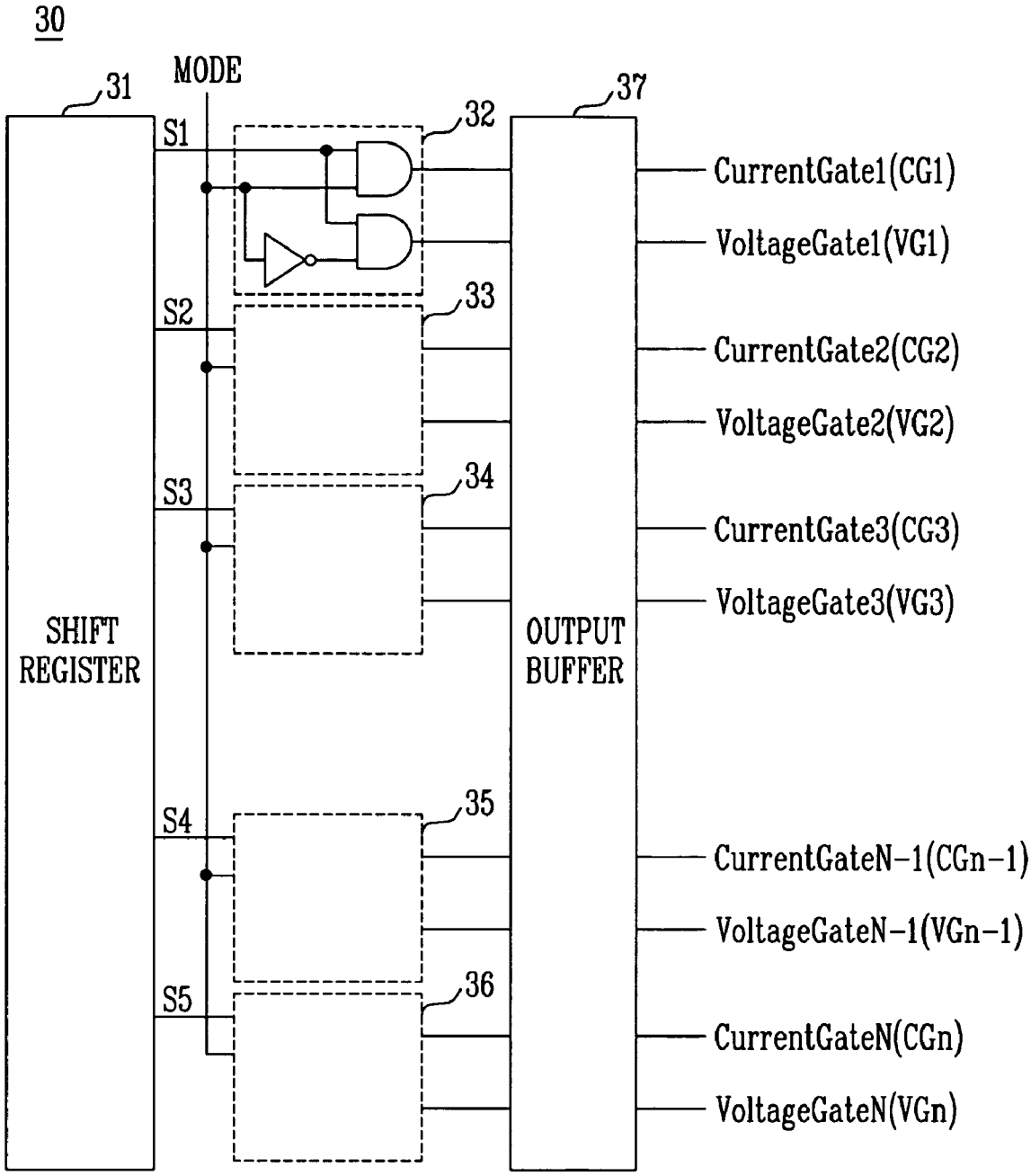
FIG. 8 is a block diagram of a gate driver that can be used for the organic EL display device of FIG. 7.

FIG. 7 is a block diagram of an organic EL display device that uses the voltage/current driven active matrix organic EL pixel circuit according to the second embodiment of the present invention, and FIG. 8 is a block diagram of a gate driver that can be used for the organic EL display device of FIG. 7.

Referring to FIGS. 7 and 8, the organic EL display device according to the second embodiment of the present invention includes a plurality of pixels 10, an image display unit 20 including voltage gate lines VG1, VG2, VG3, . . . , VGn-1, and VGn, current gate lines CG1, CG2, CG3, . . . , CGn-1, and CGn, and source lines S1, S2, S3, . . . , Sn-1, and Sn connected to the pixels 10, a gate driver 30, a source driver 40, and a controller 50. Here, each of the pixels 10 includes the pixel circuit according to the second embodiment of the present invention described with reference to FIG. 4.

To be specific, the gate driver 30 supplies a gate signal to one gate line among the voltage gate lines VG1, VG2, VG3, . . . , VGn-1, and VGn and the current gate lines CG1, CG2, CG3, . . . , CGn-1, and CGn. That is, the gate driver 30 supplies the gate signal corresponding to the kind (voltage data or current data) of the image data supplied from the source driver 40 to each of the pixels 10 in accordance with a data mode selection signal bar MODEB.

For example, as shown in FIG. 8, the gate driver 30 includes a shift register 31, a plurality of data mode control units 32, 33, 34, 35, and 36 using each output of the shift register 31 as a first input and a data mode selection signal MODE as a second input, and an output buffer 37 for transmitting the outputs of the respective data mode control units 32, 33, 34, 35, and 36 to the image display unit 20. The data mode control units 32, 33, 34, 35, and 36 perform a logic operation on one output of the shift register 31 and the data mode selection signal MODE to output one of the voltage gate signals and the current gate signals to one among the voltage gate lines VG1, VG2, VG3, . . . , VGn-1, and VGn and the current gate lines CG1, CG2, CG3, . . . , CGn-1, and CGn. Therefore, each of the data mode control units 32, 33, 34, 35, and 36 includes two input AND gates and an inverter as an example as shown in FIG. 8. Here, the data mode selection signal MODE is generated in the gate driver 30 or is input from the controller 50.

The source driver 40 supplies image data to the source lines S1, S2, S3, . . . , Sn-1, and Sn. The image data includes one of the voltage data and the current data.

The controller 50 generates a predetermined control signal to control the gate driver 30 and the source driver 40. Also, the controller 50 may supply the data mode selection signal MODE of the high level or the low level to the gate driver 30.

On the other hand, according to the above-described embodiment, the transistor includes the source, the drain, and the gate. However, according to the present invention, it is possible to realize an active device including a first electrode, a second electrode, and a third electrode and capable of controlling the amount of current that flows from the second electrode to the third electrode by the voltage applied between the first electrode and the second electrode.

The present invention relates to a voltage/current driven active matrix organic EL pixel circuit, and more particularly, to an organic EL pixel circuit capable of driving organic ELs by a voltage programming method and a current programming method using one pixel circuit. The organic EL pixel circuit can be used for a voltage driven active matrix organic EL and a current driven active matrix organic EL by programming such that the flexibility and applicability of the pixel circuit and the driving circuit are excellent.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A voltage/current driven active matrix organic electroluminescent pixel circuit, comprising:

a first switching transistor for transmitting current data of a data line;

a second switching transistor having a gate connected to the data line and for converting voltage data into current to transmit the current;

a third switching transistor for intercepting the operation of the second switching transistor during the operation of the first switching transistor;

a capacitor in which one of the current data and the voltage data is programmed; and current mirror type first and second driving transistors for supplying current to an organic light emitting diode corresponding to the data programmed in the capacitor.

2. A voltage/current driven active matrix organic electroluminescent display device, comprising:

a plurality of pixels each including the voltage/current driven active matrix organic electroluminescent pixel circuit according to claim 1 and the organic light emitting diode;

a gate driver for selectively supplying one of a voltage gate signal and a current gate signal to at least one gate line connected to the plurality of pixels;

a source driver for supplying voltage/current data to source lines connected to the plurality of pixels; and a controller for controlling the gate driver and the source driver.

3. The voltage/current driven active matrix organic electroluminescent display device according to claim 2, wherein the gate driver comprises a data mode control unit using a gate signal and a data mode selection signal output from a shift register in a predetermined order as two inputs to perform a logic operation on the two inputs such that one of the current gate signal and the voltage gate signal is output.

4. A voltage/current driven active matrix organic electroluminescent pixel circuit comprising first to fifth transistors each having a source, a drain, and a gate, the organic electroluminescent pixel circuit comprising:

a first transistor having the source connected to a power line and the drain connected to the gate thereof;

a second transistor having the source connected to the power line, the drain connected to an organic light emitting diode, and the gate connected to the gate of the first transistor;

a capacitor including a first electrode and a second electrode and having the first electrode connected to the gates of the first and second transistors and the second electrode connected to the power line;

a third transistor having the source connected to a source line, the drain connected to the drain of the first transistor, and the gate connected to a gate line;

a fourth transistor having the source connected to a ground and the gate connected to the source line; and a fifth transistor having the drain connected to the drain of the first transistor, the source connected to the drain of the fourth transistor, and the gate connected to the gate line.

5. The voltage/current driven active matrix organic electroluminescent pixel circuit according to claim 4, wherein the third and fifth transistors are selectively turned on based on one of a high level and a low level of a gate signal transmitted to the gate line.

6. A voltage/current driven active matrix organic electroluminescent display device, comprising:

a plurality of pixels each including the voltage/current driven active matrix organic electroluminescent pixel circuit according to claim 4 and the organic light emitting diode;

a gate driver for selectively supplying one of a voltage gate signal and a current gate signal to at least one gate line connected to the plurality of pixels;

a source driver for supplying voltage/current data to source lines connected to the plurality of pixels; and a controller for controlling the gate driver and the source driver.

7. The voltage/current driven active matrix organic electroluminescent display device according to claim 6, wherein the gate driver comprises a data mode control unit using a gate signal and a data mode selection signal output from a shift register in a predetermined order as two inputs to perform a logic operation on the two inputs such that one of the current gate signal and the voltage gate signal is output

8. A voltage/current driven active matrix organic electroluminescent display device, comprising:

a plurality of pixels each including the voltage/current driven active matrix organic electroluminescent pixel circuit according to claim 5 and the organic light emitting diode;

a gate driver for selectively supplying one of a voltage gate signal and a current gate signal to at least one gate line connected to the plurality of pixels;

a source driver for supplying voltage/current data to source lines connected to the plurality of pixels; and a controller for controlling the gate driver and the source driver.

9. The voltage/current driven active matrix organic electroluminescent display device according to claim 8, wherein the gate driver comprises a data mode control unit using a gate signal and a data mode selection signal output from a shift register in a predetermined order as two inputs to perform a logic operation on the two inputs such that one of the current gate signal and the voltage gate signal is output.

10. A voltage/current driven active matrix organic electroluminescent pixel circuit comprising first to fifth transistors each having a source, a drain, and a gate, the organic electroluminescent pixel circuit comprising:

a first transistor having the source connected to a power line and the drain connected to the gate thereof;

a second transistor having the source connected to the power line, the drain connected to an organic fight emitting diode, and the gate connected to the gate of the first transistor;

a capacitor including a first electrode and a second electrode and having the first electrode connected to the gates of the first and second transistors and the second electrode connected to the power line;

a third transistor having the drain connected to a source line, the source connected to the drain of the first transistor, and the gate connected to a current gate line;

a fourth transistor having the source connected to a ground and the gate connected to the source line; and a fifth transistor having the drain connected to the drain of the first transistor, the source connected to the drain of the fourth transistor, and the gate connected to a voltage gate line.

11. The voltage/current driven active matrix organic electroluminescent pixel circuit according to claim 10, further comprising a data mode control unit for performing a logic operation on input gate and data mode selection signals to output one of a current gate signal and a voltage gate signal to one of the current gate line and the voltage gate line.

12. A voltage/current driven active matrix organic electroluminescent display device, comprising:

a plurality of pixels each including the voltage/current driven active matrix organic electroluminescent pixel circuit according to claim 11 and the organic light emitting diode;

a gate driver for selectively supplying one of a voltage gate signal and a current gate signal to at least one gate line connected to the plurality of pixels;

a source driver for supplying voltage/current data to source lines connected to the plurality of pixels; and a controller for controlling the gate driver and the source driver.

13. The voltage/current driven active matrix organic electroluminescent display device according to claim 12, wherein the gate driver comprises a data mode control unit using a gate signal and a data mode selection signal output from a shift register in a predetermined order as two inputs to perform a logic operation on the two inputs such that one of the current gate signal and the voltage gate signal is output.

14. A voltage/current driven active matrix organic electroluminescent display device, comprising:

a plurality of pixels each including the voltage/current driven active matrix organic electroluminescent pixel circuit according to claim 10 and the organic light emitting diode;

a gate driver for selectively supplying one of a voltage gate signal and a current gate signal to at least one gate line connected to the plurality of pixels;

a source driver for supplying voltage/current data to source lines connected to the plurality of pixels; and a controller for controlling the gate driver and the source driver.

15. The voltage/current driven active matrix organic electroluminescent display device according to claim 14, wherein the gate driver comprises a data mode control unit using a gate signal and a data mode selection signal output from a shift register in a predetermined order as two inputs to perform a logic operation on the two inputs such that one of the current gate signal and the voltage gate signal is output.

* * * * *